United States Patent [19]

Amonett

[11] Patent Number: 4,841,110

[45] Date of Patent: Jun. 20, 1989

[54] TIMING MECHANISM WITH CAM AND SWITCH ARRANGEMENT

[75] Inventor: Daniel K. Amonett, Indianapolis, Ind.

[73] Assignee: Emhart Industries, Inc., Indianapolis, Ind.

[21] Appl. No.: 91,368

[22] Filed: Aug. 27, 1987

Related U.S. Application Data

[63] Continuation of Ser. No. 896,733, Aug. 15, 1986, abandoned.

[51] Int. Cl.[4] ..... H01H 19/62

[52] U.S. Cl. ..... 200/574; 200/30 R

[58] Field of Search ..... 200/153 L, 153 LA, 153 LB, 200/30 R, 1 A, 1 TK, 30 AA, 27 R, 27 B

[56] References Cited

U.S. PATENT DOCUMENTS

| | | | |
|---|---|---|---|
| 1,092,266 | 4/1914 | Howe | 200/153 LB |
| 2,842,626 | 7/1958 | Gallagher et al. | 200/30 R |
| 2,957,970 | 10/1960 | Taylor | 200/153 LB |
| 2,974,212 | 3/1961 | Stolle et al. | 200/1 A |
| 2,988,932 | 6/1961 | Swanson | 200/153 LB |
| 3,217,226 | 11/1965 | Strain | 200/153 LB |

*Primary Examiner*—Henry J. Recla
*Assistant Examiner*—Linda J. Sholl
*Attorney, Agent, or Firm*—Carl A. Forest

[57] ABSTRACT

A cam follower is pivotally mounted on an electrical contact blade. The cam follower provides a ramp surface when engaging a step of the cam and a sharp drop off when dropping from a step. The ramp surface provides a smooth transition from a lower surface while the sharp drop off provides for a quick make and break of electrical contacts.

6 Claims, 1 Drawing Sheet

TIMING MECHANISM WITH CAM AND SWITCH ARRANGEMENT

This application is a continuation of application Ser. No. 06/896,733, filed 8-15-86 now abandoned.

BACKGROUND OF THE INVENTION

The present invention relates to a timing mechanism and more particularly to a cam follower arrangement for such a mechanism.

Timing mechanisms have been used for many years to control the functions of an appliance such as a washer or dryer. In such mechanisms, the timing is provided by a cam or cams which opens and closes electrical switches in a programmed sequence. The switches usually include electrical contact blades carrying mating electrical contacts. A cam follower is usually fixed to one of the blades and engages a cam to move the blade in accordance with the cam's profile.

In such an arrangement, one of the problems has always been to provide as much as possible a quick make and break of the electrical contacts. Such quick make and break greatly reduces double arcing and erosion of the electrical contacts. In addition, it is always desirable that the transition of the cam follower going up a cam step be as smooth as possible. The present invention provides a structure which substantially meets these problems.

SUMMARY OF THE INVENTION

Accordingly, there is provided a timing mechanism which in general comprises cam means and switch means biased by the cam means, the switch means including cooperating electrical contact blades and electrical contacts carried by the electrical contact blades, and a cam follower pivotally mounted on one of the electrical contact blades and engaging the cam means, the cam follower being constructed and arranged such that a ramp surface is provided on the cam follower when it is raised over a step of the cam means, and a surface that is substantially normal to a cam surface of the cam means when the cam follower drops from a cam surface of the cam means.

DETAILED DESCRIPTION OF THE INVENTION

Figure 1:
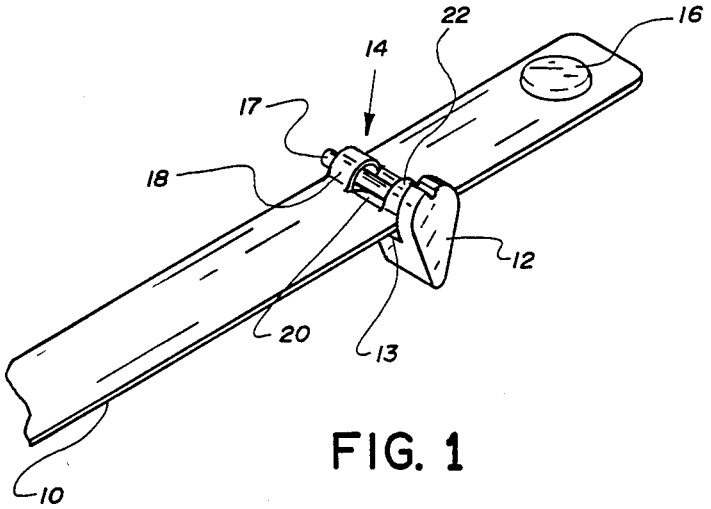
FIG. 1 is an isometric view of an electrical contact blade and its cam follower.

Referring to the drawings, there is shown an electrical contact blade 10 having an electrical contact 16 at an end thereof. A V-shaped cam follower 12 is pivotally mounted on the blade through a pin 17 which engages a spring socket 14 which is formed by lancing the blade to form three protruding strips 18, 20 and 22. Cam follower 12 includes a ledge 13 which limits the amount of pivot of the cam follower through engagement of the ledge with blade 10.

Figure 2:
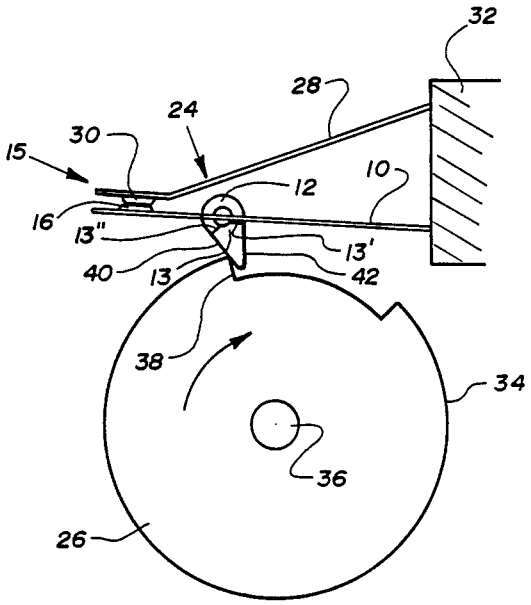
FIGS. 2 and 3 are views showing the use of the electrical contact blade in a switch and its relationship to a cam.
Figure 3:
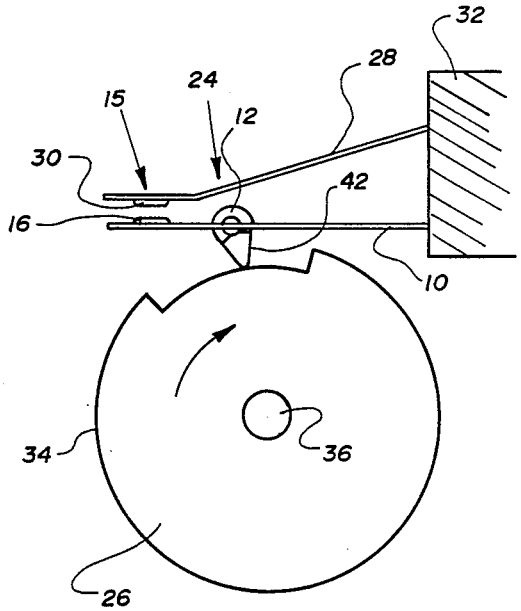

Referring particularly to FIGS. 2 and 3, the electrical contact blade is shown operating in a timing mechanism 15 wherein a switch 24 is opened and closed by a cam 26. Switch 24 includes electrical contact blade 10 with its electrical contact 16 and electrical contact blade 28 having an electrical contact 30 which is positioned to mate electrical contact 16. The blades are held by a terminal blocK 32. Cam 26 is rotated on shaft 36 through a motor (not shown).

As shown, cam follower 12 engages cam surface 34 of cam 26 to move electrical contact blade 10 to open and close the electrical contacts in a manner well known in the art. With cam 26 being rotated in the direction shown by the arrow, cam follower 12 will, upon reaching step 38 of the cam, pivot as shown in FIG. 2, to provide a ramp surface 40 for a smooth transition of the follower up the step. Surface 42 is substantially normal to a tangent of cam surface 34. The amount the cam follower pivots is limited by edge 13' of ledge 13. In FIG. 3, the cam has completed a revolution and cam follower 12 has dropped off of cam surface 34. Now surface 42 of cam follower 12 remains substantially the same as before to provide a fast drop of the cam follower.

Since the cam follower 12 is V-shaped and symetrical about the axis of pin 17 or the pivot axis of the cam follower, cam follower 12 will perform the same way regardless of the direction of rotation of the cam with the functions of surfaces 40 and 42 being reversed. The amount the cam follower will pivot will be determined by edge 13" of ledge 13.

What is claimed is:

1. A timing mechanism comprising:

cam means rotatably mounted for providing a caming function, said cam means having at least one cam step;

switch means for providing a switching function, said switch means including a cam follower and means for providing a ramping function when said cam follower is raised over said step and for providing a quick break switching function, which is substantially quicker than that which would be provided by said ramping function, when said cam follower drops over said step, regardless of the direction of rotation of said cam means;

said means for providing a ramping function and a quick break switching function comprises:

a pivot means for pivoting said cam follower about a pivot axis; and means for limiting the amount of pivot of said cam follower;

said means for limiting the amount of pivot of said cam follower includes a ledge carried by said cam follower;

said switch means further comprises an electrical switch blade and said pivot means comprises a socket on said blade and a pin extending from said cam follower and engaging said socket;

wherein said ledge and said electrical switch blade contact each other to limit the pivot of said cam follower.

2. A timing mechanism according to claim 1 wherein said cam follower is symmetrical about its pivot axis.

3. A timing mechanism as in claim 1 wherein said cam follower is V-shaped.

4. A timing mechanism as in claim 1 wherein said socket comprises a plurality of strips lanced from said blade.

5. A timing mechanism comprising:

cam means rotatably mounted for providing a caming function, said cam means having at least one cam step substantially perpendicular to the cam surface;

switch means for providing a switching function, said switch means including a V-shaped cam follower and means for providing a ramping function when said cam follower is raised over said step and for providing a quick break switching function, which is substantially quicker than that which would be provided by said ramping function, when said cam follower drops over said step, regardless of the direction of rotation of said cam means, said means for providing a ramping function and a quick break switching function including: a pivot means for pivoting said cam follower about a pivot axis; and a stop limiting the amount of pivot of the cam follower, said stop placed so that the trailing surface of said cam follower is substantially normal to the tangent to a cam surface of said cam means when said stop is engaged.

6. A timing mechanism in accordance with claim 1 wherein said cam follower is V-shaped and said ledge is placed so that the trailing surface of said cam follower is substantially normal to the tangent to a cam surface of said cam means when said ledge is engaged.

* * * * *